US011334002B2

(12) United States Patent
Koga et al.

(10) Patent No.: US 11,334,002 B2
(45) Date of Patent: May 17, 2022

(54) DEVELOPING APPARATUS WITH MAGNETIC SEAL MEMBER FACING CONVEYANCE SCREW

(71) Applicant: CANON KABUSHIKI KAISHA, Tokyo (JP)

(72) Inventors: Yutaka Koga, Kashiwa (JP); Naoyuki Furukawa, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/285,345

(22) Filed: Feb. 26, 2019

(65) Prior Publication Data

US 2019/0278199 A1 Sep. 12, 2019

(30) Foreign Application Priority Data

Mar. 7, 2018 (JP) ..... 2018-040944

(51) Int. Cl.
*G03G 15/08* (2006.01)
*G03G 15/09* (2006.01)

(52) U.S. Cl.
CPC ..... *G03G 15/0898* (2013.01); *G03G 15/0891* (2013.01); *G03G 15/0893* (2013.01); *G03G 15/0942* (2013.01)

(58) Field of Classification Search
CPC ..... G03G 15/0891; G03G 15/0893; G03G 15/0817; G03G 15/0898; G03G 15/0942; G03G 2215/0838
USPC ..... 399/104
See application file for complete search history.

(56) References Cited

U.S. PATENT DOCUMENTS 5,267,007 A * 11/1993 Watanabe ..... G03G 15/0942 399/104
5,552,864 A * 9/1996 Malicki ..... G03G 15/0817 399/104
6,467,965 B1 10/2002 Wyer
2010/0322663 A1* 12/2010 Kofferlein ..... G03G 15/0942 399/104
2011/0064472 A1* 3/2011 Sakurai ..... G03G 15/0817 399/254
2016/0085180 A1* 3/2016 Honda ..... G03G 15/0891 399/254

(Continued)

FOREIGN PATENT DOCUMENTS

GB 2244762 A * 12/1991 ..... F16J 15/43
JP 60028673 A * 2/1985 ..... B01F 7/043

(Continued)

OTHER PUBLICATIONS

Japanese Office Action dated Jan. 25, 2022, in related Japanese Patent Application No. 2018-040944.

*Primary Examiner* — Robert B Beatty
(74) *Attorney, Agent, or Firm* — Venable LLP

(57) ABSTRACT

A developing apparatus includes a developer container that stores developer, a conveyance screw including a shaft portion and a blade, a bearing portion configured to engage with an engagement portion of the shaft portion of the conveyance screw, and a magnetic seal member having a magnetic property and disposed along a peripheral surface of the shaft portion in a noncontact manner with respect to the shaft portion between the blade and the engagement portion in the rotational axis direction of the conveyance screw.

16 Claims, 5 Drawing Sheets

(56) References Cited

U.S. PATENT DOCUMENTS

2017/0285523 A1* 10/2017 Itabashi ..... G03G 15/0889

FOREIGN PATENT DOCUMENTS

| | | | | |
|---|---|---|---|---|
| JP | 63124075 | A | * | 5/1988 |
| JP | 04245270 | A | * | 9/1992 |
| JP | 2003-021968 | A | | 1/2003 |
| JP | 2004353764 | A | * | 12/2004 |
| JP | 2007171865 | A | * | 7/2007 |
| JP | 2012230332 | A | * | 11/2012 |
| JP | 2014002247 | A | * | 1/2014 |
| JP | 2014-235367 | A | | 12/2014 |

* cited by examiner

DEVELOPING APPARATUS WITH MAGNETIC SEAL MEMBER FACING CONVEYANCE SCREW

BACKGROUND OF THE INVENTION

Field of the Invention

The present invention relates to a developing apparatus that is suitable for application to an image forming apparatus that adopts an electrophotography technique, such as a printer, a copying machine, a facsimile or a multifunction printer.

Description of the Related Art

The image forming apparatus is equipped with a developing apparatus that develops an electrostatic latent image formed on a photosensitive drum into a toner image using developer, and in the developing apparatus, developer is conveyed in circulation by a conveyance screw in a developer container. Further, the image forming apparatus is equipped with a replenishment apparatus that replenishes toner to the developing apparatus, and in the replenishment apparatus, developer in the developer container is conveyed by the conveyance screw. Further, the image forming apparatus includes a cleaning device for removing developer and the like remaining on the photosensitive drum or an intermediate transfer belt after transfer, and in the cleaning device, removed developer is conveyed in the developer container by the conveyance screw.

The above-described conveyance screw is supported rotatably on a bearing provided on the developer container. The bearing includes a non-opened bearing recess portion that is recessed cylindrically, and an end of a rotation shaft portion of a conveyance screw is inserted to the bearing recess portion in a rotatable manner. However, if developer enters the bearing, toner contained in the entered developer melts by heat, i.e., frictional heat, generated by friction of the bearing and the conveyance screw, and thereafter when the melted developer cools, it may aggregate and adhere to the bearing. When developer is adhered to the bearing, driving load of the conveyance screw increases. Heretofore, a rubber seal was arranged to prevent developer from entering the bearing, or as disclosed in Japanese Patent Application Laid-Open Publication No. 2014-235367, a groove was formed to a rotation shaft portion of a conveyance screw without providing a rubber seal, and developer having entered the bearing was returned through the space formed by the groove to the developer container.

According to the apparatus disclosed in the above-described Japanese Patent Application Laid-Open Publication No. 2014-235367, developer having entered the bearing is returned to the developer container through the groove formed on the rotation shaft portion, but since there is no rubber seal arranged on the bearing, developer may enter the bearing and adhere thereto. A rubber seal may be arranged on the bearing to prevent this problem. However, if a rubber seal is arranged, the above-described function of returning the developer to the developer container becomes difficult to achieve, and the rotation shaft portion of the conveyance screw sliding against the rubber seal may generate heat, increasing the possibility of the developer being aggregated. If a ball bearing having a rubber seal, i.e., a seal bearing, is adopted as the bearing, the number of components and costs are undesirably increased.

SUMMARY OF THE INVENTION

According to one aspect of the present invention, a developing apparatus includes a developer container that stores developer including magnetic carrier and toner, a conveyance screw including a shaft portion and a blade formed helically around the shaft portion, the conveyance screw being configured to convey developer in the developer container, a bearing portion formed of resin, arranged on the developer container and configured to support the conveyance screw rotatably, the bearing portion being formed in a cylindrical shape including a bottom surface that opposes to the shaft portion of the conveyance screw in a rotational axis direction of the conveyance screw, and being configured to engage with an engagement portion of the shaft portion of the conveyance screw, and a magnetic seal member having a magnetic property and disposed along a peripheral surface of the shaft portion in a noncontact manner with respect to the shaft portion between the blade and the engagement portion in the rotational axis direction of the conveyance screw.

Further features of the present invention will become apparent from the following description of exemplary embodiments with reference to the attached drawings.

DESCRIPTION OF THE EMBODIMENTS

Image Forming Apparatus

Figure 1:
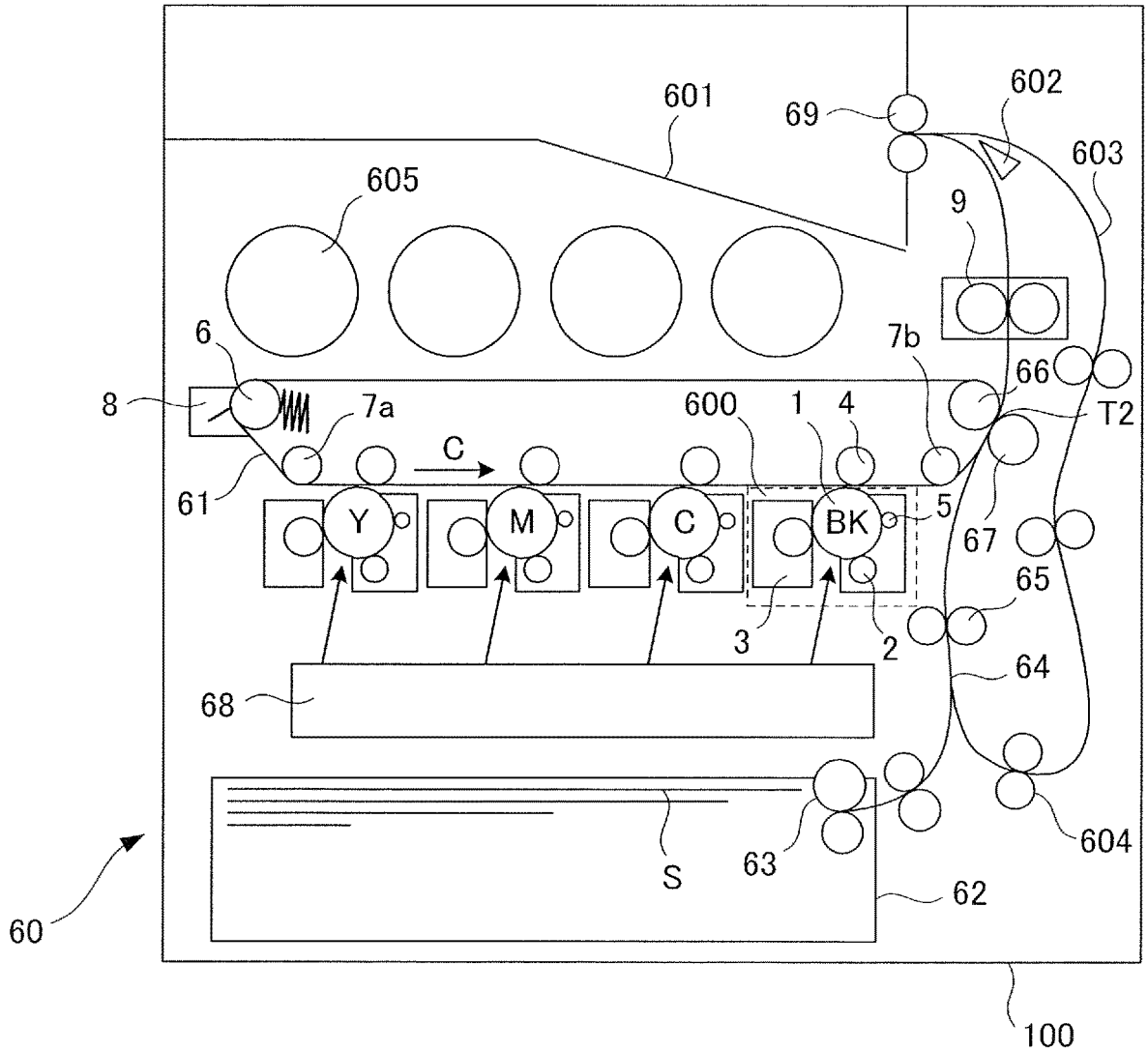
FIG. 1 is a schematic view illustrating a configuration of an image forming apparatus that is suitable for applying a developing apparatus according to a present embodiment.

Now, a developing apparatus according to a present embodiment will be described. At first, a configuration of an image forming apparatus suitable for applying the developing apparatus of the present embodiment will be described with reference to FIG. 1. An image forming apparatus 60 illustrated in FIG. 1 is a so-called intermediate-transfer tandem-type color image forming apparatus in which image forming units 600 of four colors are arranged opposed to an intermediate transfer belt 61 in an apparatus body 100.

We will now describe a process for conveying a recording material in the image forming apparatus 60. Recording material S is stored in a stacked manner in a recording material storage, i.e., cassette, 62, and the recording material is fed by a sheet feed roller 63 at a matched timing with an image forming timing. A friction separation system, for example, is adopted to feed sheets from the recording material storage 62. The recording material S fed by the sheet feed roller 63 is conveyed to a registration roller 65 arranged in midway of a conveyance path 64. After performing skew correction and timing correction of the recording material S at the registration roller 65, the recording material S is sent to a secondary transfer portion T2. The secondary transfer portion T2 is a transfer nip portion formed by a secondary transfer inner roller 66 and a secondary transfer outer roller 67 which are opposed to one another, and toner image is adhered to the recording material S by applying predetermined pressure and electrostatic load bias.

Regarding the above-described conveyance process of the recording material S to the secondary transfer portion T2, an image forming process of the image sent to the secondary transfer portion T2 at a similar timing will be described. At first, the image forming units 600 will be described. The image forming units 600 of respective colors are basically the same except for the different toner colors, so that in FIG. 1, only the image forming unit 600 corresponding to black (BK) is denoted with reference numbers and the image forming units of other colors are not denoted with reference numbers. The image forming unit 600 corresponding to black (BK) is described below as the example.

The image forming unit 600 is mainly composed of a photosensitive drum 1, a charging apparatus 2, a developing apparatus 3, a photosensitive drum cleaner 5, and so on. A surface of the photosensitive drum 1 driven to rotate is uniformly charged in advance by the charging apparatus 2, and thereafter, an electrostatic latent image is formed by an exposing unit 68 driven according to an image information signal. Next, the electrostatic latent image formed on the photosensitive drum 1 is visualized by the developing apparatus 3 that develops the image using toner. That is, the developing apparatus 3 develops the electrostatic latent image using toner contained in the developer as described later and forms a toner image on the photosensitive drum 1. The developing apparatus 3 will be described later with reference to FIGS. 2 and 3.

Thereafter, predetermined pressure and electrostatic load bias is applied by a primary transfer roller 4 that is arranged opposite to the image forming units 600 interposing the intermediate transfer belt 61, and the toner image formed on the photosensitive drum 1 is primarily transferred to the intermediate transfer belt 61. After primary transfer, primary transfer residual toner remaining on the photosensitive drum 1 is collected by the photosensitive drum cleaner 5.

According to the present embodiment, there are four sets of image forming units 600 respectively corresponding to yellow (Y), magenta (M), cyan (C) and black (BK). However, the number of colors is not restricted to four and the order in which the colors are arranged is not restricted to this order. Further, the developing apparatus 3 uses two-component developer including nonmagnetic toner and magnetic carrier as developer. In this case, toner is consumed by developing images, so that toner can be replenished from a toner bottle 605 storing toner to the developing apparatus 3. Developer for replenishment stored in advance in the toner bottle 605 is replenished into the developing apparatus 3 by a toner replenishment apparatus not shown.

The intermediate transfer belt 61 to which the toner image is primarily transferred is an endless belt stretched across a tension roller 6, the secondary transfer inner roller 66 and driven rollers 7*a* and 7*b* and moved to the direction of arrow C in the drawing. The image forming processes of respective colors carried out in parallel by the respective image forming units 600 are performed at a timing at which the images are sequentially formed on top of a toner image of other colors primarily transferred onto the intermediate transfer belt 61 upstream in the direction of movement. As a result, a full-color toner image is finally formed on the intermediate transfer belt 61 and conveyed to the secondary transfer portion T2. The secondary transfer residual toner remaining on the intermediate transfer belt 61 after passing through the secondary transfer portion T2 is collected from the intermediate transfer belt 61 by a transfer cleaner device 8.

According to the conveyance process and the image forming process respectively described above, the timing of the recording material S and the full-color toner image is matched at the secondary transfer portion T2, and secondary transfer is performed where the toner image is transferred from the intermediate transfer belt 61 to the recording material S. Thereafter, the recording material S is conveyed to a fixing unit 9 where heat and pressure is applied to the recording material S, and thereby, the toner image is melted and adhered to the recording material S. The recording material S to which image has been fixed is either discharged onto a sheet discharge tray 601 or subjected to duplex image forming process by normal rotation of a sheet discharge roller 69.

If duplex image forming process is required, the sheet discharge roller 69 is rotated in normal rotation until a trailing edge of the recording material S is conveyed to pass through a switching member 602, and thereafter, the sheet discharge roller 69 is rotated in reverse rotation to switch the trailing edge with the leading edge, before the recording material S is conveyed to a duplex conveyance path 603. Thereafter, at a matched timing with a recording material of a subsequent job conveyed from the sheet feed roller 63, the recording material S is sent again to the conveyance path 64 by a sheet refeed roller 604. The sheet conveyance process and an image forming process to a rear side of the sheet is similar to the processes described above, so descriptions thereof are omitted.

Developing Apparatus

Figure 2:
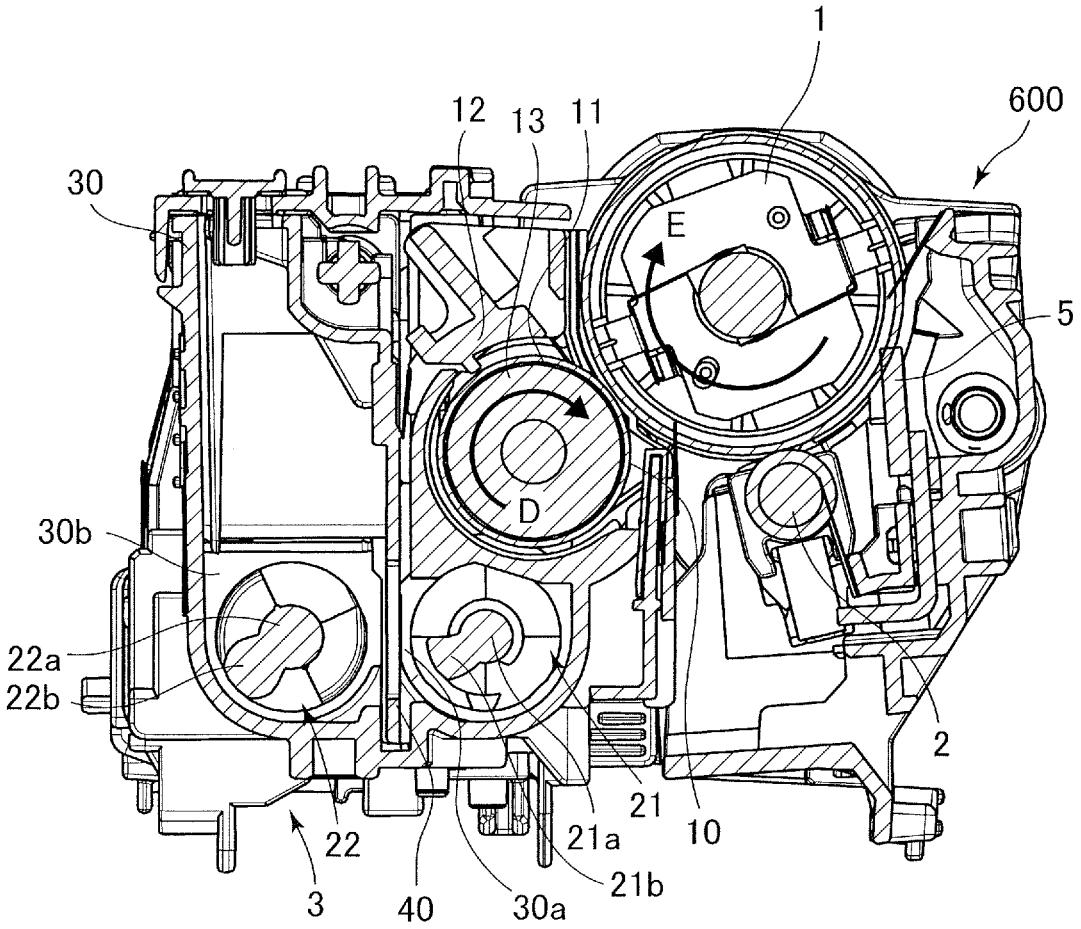
FIG. 2 is a cross-sectional view illustrating the developing apparatus.

Next, the developing apparatus 3 will be described with reference to FIGS. 2 and 3. As illustrated in FIG. 2, the developing apparatus 3 of the present embodiment includes a developer container 30 that forms a housing, a developing sleeve 10, a developing screw 21, an agitating screw 22, and a regulating blade 12.

A two-component developer containing nonmagnetic toner and magnetic carrier, hereinafter simply referred to as developer, is stored in the developer container 30. That is, the developing apparatus 3 according to the present embodiment adopts a two-component image developing system as the image developing system and uses developer where nonmagnetic toner charged with negative polarity and magnetic carrier charged with positive polarity are mixed. Nonmagnetic toner is formed by including a coloring agent, an additive such as colloidal silica fine powder and a wax in resin material such as polyester and styrene acryl, and pulverizing or polymerizing the material into powder. Magnetic carrier is formed by applying a resin coating to a surface layer of a core formed of ferrite particles or resin particles formed by kneading magnetic powder.

A portion of the developer container 30 formed of resin opposed to the photosensitive drum 1 is opened, and a portion of the developing sleeve 10 capable of bearing developer and rotating is arranged to be exposed through this opening. The developing sleeve 10 is formed into a cylindrical shape of a nonmagnetic material such as aluminum and stainless steel, and it is rotated in a direction opposite to the rotation of the photosensitive drum 1 at an opposing surface as the photosensitive drum 1 (refer to arrow D and arrow E in the drawing). The direction of rotation of the developing sleeve 10 can be the same direction as the photosensitive drum 1 at the opposing surface with the photosensitive drum 1.

A magnet roller 13 is fixed in the developing sleeve 10. A magnetic brush of developer is formed on the surface of the developing sleeve 10 by magnetic force of the magnet roller 13. The magnetic brush formed on the surface of the developing sleeve 10 has its thickness regulated by the regulating blade 12 while being sent to a predetermined development area. The regulating blade 12 is a plate-shaped member formed of a nonmagnetic material such as aluminum, which is arranged along a rotational axis direction, i.e., longitudinal direction, of the developing sleeve 10. By having the magnetic brush sent to the developing area brush against the photosensitive drum 1, the electrostatic latent image formed on the photosensitive drum 1 is developed as a toner image. In that case, either only DC voltage or superimposed voltage where DC voltage and AC voltage are superimposed is applied as a developing voltage by a power supply (not shown) to the developing sleeve 10.

A developing chamber 30*a* and an agitating chamber 30*b* are formed in the developer container 30, and a partition wall 40 that separates the developing chamber 30*a* and the agitating chamber 30*b* is arranged between the developing chamber 30*a* and the agitating chamber 30*b*. The partition wall 40 protrudes from a bottom portion into the developer container 30, separating the developing chamber 30*a* and the agitating chamber 30*b*. Further, the partition wall 40 extends in a rotational axis direction, that is, longitudinal direction, of the developing sleeve 10, and divides the inner side of the developer container 30 so that the developing chamber 30*a* and the agitating chamber 30*b* are approximately arranged side by side in the horizontal direction.

Figure 3:
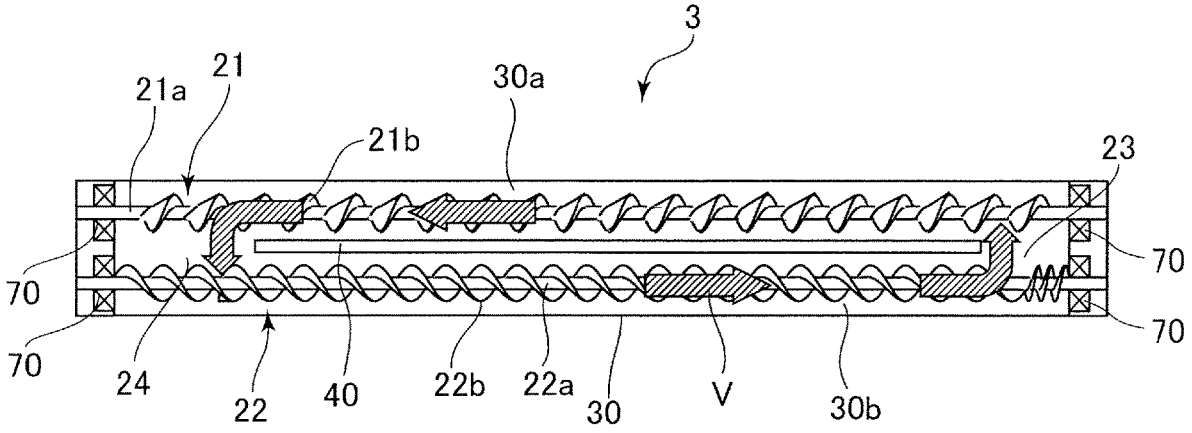
FIG. 3 is a cross-sectional top view illustrating the developing apparatus taken at a horizontal cross-section including an axial direction.

The partition wall 40 includes a first communication portion 23 and a second communication portion 24 that communicate the developing chamber 30*a* and the agitating chamber 30*b* at both end portions in the longitudinal direction, as illustrated in FIG. 3. The first communication portion 23 is a path through which developer is conveyed from the agitating chamber 30*b* to the developing chamber 30*a*, and the second communication portion 24 is a path through which developer is conveyed from the developing chamber 30*a* to the agitating chamber 30*b*.

The developing screw 21 capable of conveying developer in a predetermined first direction in the developing chamber 30*a* is arranged in the developing chamber 30*a*. The agitating screw 22 capable of conveying developer in a second direction opposite to the first direction in the agitating chamber 30*b* is arranged in the agitating chamber 30*b*. The developing screw 21 and the agitating screw 22 are formed by arranging helical blades 21*b* and 22*b* around rotation shaft portions 21*a* and 22*a*, respectively, and the developing screw 21 and the agitating screw 22 are supported at both end portions in the rotational axis direction by bearing members 70 (refer to FIG. 4 described later).

According to the present embodiment, the rotation shaft portions 21*a* and 22*a* and helical blades 21*b* and 22*b* are formed integrally using a resin material having a high abrasion resistance to which developer is hardly adhered, such as polyacetal (POM), polycarbonate (PC), polyamide (PA), ABS resin and the like. In a state where the agitating screw 22 serving as a conveyance screw rotates together with the developing screw 21 by a motor not shown, developer is conveyed in circulation within the developer container 30 while being agitated (refer to arrow V of FIG. 3). The rotation shaft portions 21*a* and 22*a* may also be formed of metal material such as iron.

Bearing Member

Figure 4:
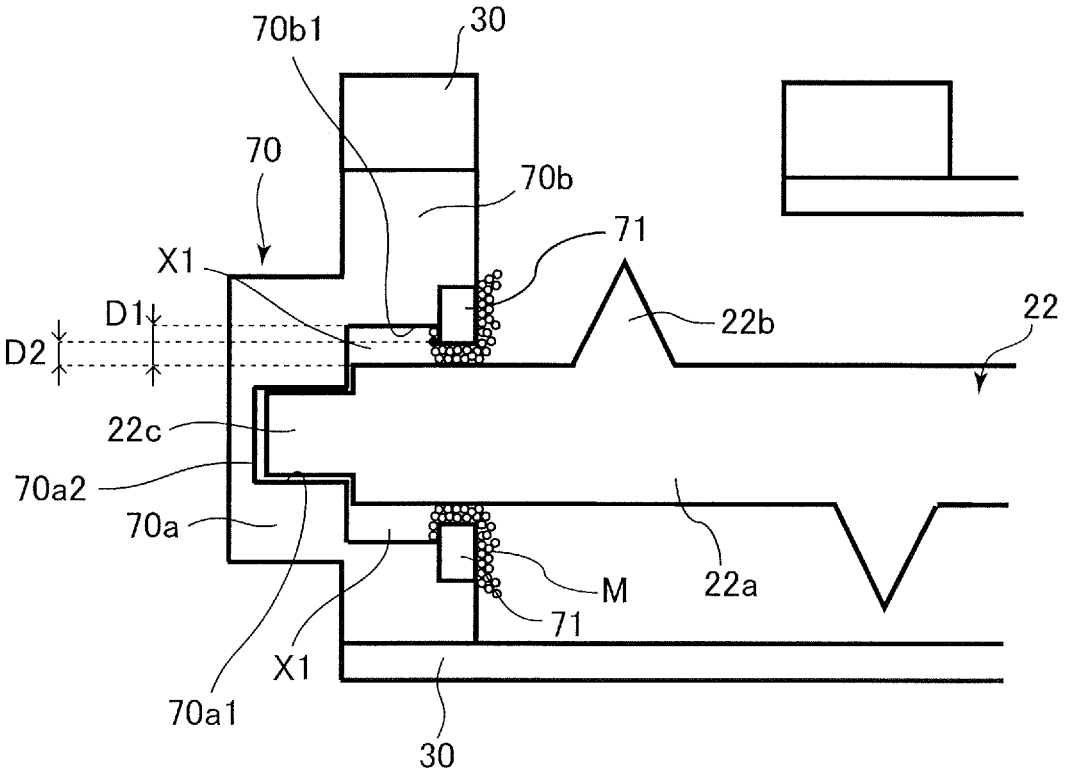
FIG. 4 is a cross-sectional view illustrating a vicinity of a bearing member according to a first embodiment in enlarged view.

As described above, the developing screw 21 and the agitating screw 22 have both end portions thereof respectively rotatably supported by the bearing members 70 provided on the developer container 30. In the following description, the bearing members 70 according to the first embodiment will be described with reference to FIG. 4. FIG. 4 illustrates a vicinity of the bearing member 70 supporting a first end portion of the agitating screw 22 in enlarged view. In the present embodiment, the bearing member supporting a second end portion of the agitating screw 22 and the bearing members supporting a first end and a second end of the developing screw 21 are configured similarly as the bearing member 70 illustrated in FIG. 4, so that detailed descriptions thereof are omitted. Further, in the following description, a screw that conveys toner, such as the developing screw 21 and the agitating screw 22, is also referred to as a conveyance screw.

The bearing member 70 is a slide bearing having a cylindrical shape formed of resin and attached, for example, to a side wall of the developer container 30. The bearing member 70 is preferably formed of a resin material such as polyacetal or polyamide containing fluorine and the like, that has a property to be easily worn but also slidable compared to the agitating screw 22. As an example, if the agitating screw 22 is formed of polyacetal, it is preferable to form the bearing member 70 of polyamide since both high durability and low abrasiveness is achievable. If the developer container 30 is formed of the resin material described above, the bearing member 70 should preferably be integrally molded with the developer container 30 to contribute to lower costs.

As illustrated in FIG. 4, the bearing member 70 is engaged with the rotation shaft portion 22*a* at an end portion in a rotational axis direction of the agitating screw 22 to rotatably support the agitating screw 22. Specifically, the agitating screw 22 includes a projected end portion 22*c* serving as a projected portion that protrudes in a rotational axis direction from an end portion of the rotation shaft portion 22*a*. The projected end portion 22*c* forms the engagement portion of the shaft of the agitating screw 22. Meanwhile, the bearing member 70 serving as bearing includes a bearing recess portion 70*a* that is non-opened and engageable with the projected end portion 22*c* having an outer diameter that is smaller than the diameter of the rotation shaft portion 22*a*. The bearing recess portion 70*a* is formed in a cylindrically recessed shape, and in a state where the above-described projected end portion 22*c* is rotatably inserted thereto, the bearing recess portion 70*a* and the projected end portion 22*c* are engaged. According to the present embodiment, the bearing member 70 is formed so that the bearing recess portion 70*a* covers an end portion of the rotation shaft portion 22*a*, that is, the projected end portion 22*c*, such that the projected end portion 22*c* does not pass through the bearing member 70 and be exposed to the exterior of the developer container 30.

That is, an inner surface 70*a*1 of a recessed portion of the bearing recess portion 70*a* serves as a bearing portion formed of resin material that supports the conveyance screw 22 in a rotatable manner. The bearing portion 70*a*1 has a cylindrical shape with a bottom surface 70*a*2 that opposes to the shaft portion 22*a* and 22*c* of the conveyance screw 22 in the rotational axis direction of the conveyance screw 22, and is engaged with an engagement portion 22*c* of the shaft portion 22*a* and 22*c* of the conveyance screw 22.

The bearing member 70 also includes a second recess portion 70*b* that is formed adjacent to the bearing recess portion 70*a*, i.e., first recess portion, engaged with the projected end portion 22*c* in the rotational axis direction. The second recess portion 70*b* has an inner diameter that is greater than a diameter of the rotation shaft portion 22*a*, such that a stepped portion is formed by the second recess portion 70*b* and the bearing recess portion 70*a*. Since the bearing member 70 includes a stepped recess portion, a space portion X1 described later is secured, which prevents the second recess portion 70*b* and the rotation shaft portion 22*a* from sliding against one another during rotation. Further, the stepped recess portion enables the projected end portion 22*c* to be arranged at a certain distance, such as 1 to 3 mm, from the bearing recess portion 70*a* so that the surface of the projected end portion 22*c* opposed to the bearing recess portion 70*a* in the rotational axis direction does not slide against the bearing recess portion 70*a*. That is, the length of the projected end portion 22*c* in the rotational axis direction is shorter than the length of the bearing recess portion 70*a* in the rotational axis direction. Thus, the heat that is generated by the agitating screw 22 sliding against the bearing member 70 during rotation is suppressed as much as possible. It is preferable that an inner diameter of the second recess portion 70*b* is formed smaller than an outer diameter of the agitating screw including the helical blade 22*b*. The second end of the agitating screw 22 is also axially supported by a bearing member formed of resin.

Magnetic Seal Member

As described earlier, if developer enters the bearing member 70, to be more precise, the bearing recess portion 70*a*, the developer, mainly toner, melts by the heat generated by sliding friction with the rotating agitating screw 22, and thereafter, cools, aggregates and adheres to the bearing member 70. If developer adheres to the bearing member 70, the agitating screw 22 may not rotate at an appropriate rotational speed, or the shaft may break. Therefore, according to the present embodiment, a magnetic seal member 71 is provided to the bearing member 70 to suppress entry of developer to the bearing member 70. That is, the magnetic seal member 71 serves as a magnetic seal member having a magnetic property that is provided along a peripheral surface of the rotation shaft portion 22*a* between the helical blade 22*b* and the engagement portion 22*c* in the rotational axis direction of the conveyance screw and also provided in a noncontact manner with respect to the rotation shaft portion 22*a*. The magnetic seal member 71 is not necessarily attached to the bearing member 70, and it can be provided on the developer container 30. That is, if it is considered that the state in which the bearing member 70 is attached to the developer container 30 constitutes the developer container containing developer, not only the magnetic seal member 71 but also the bearing portion 70*a*1 should merely be provided on the developer container, and the bearing member 70 and the developer container 30 can be formed integrally, separately or in any other way.

As illustrated in FIG. 4, the magnetic seal member 71 is arranged on the bearing member 70 at an area close to an inner side of the developer container 30 than the bearing recess portion 70*a* in a manner capable of magnetically blocking entry of developer to the bearing recess portion 70*a*. The magnetic seal member 71 is, for example, a ring magnet formed in the shape of a ring that covers a portion of the area of the rotation shaft portion 22*a* in a noncontact manner along the outer peripheral surface of the rotation shaft portion 22*a* opposed to the peripheral surface of the rotation shaft portion 22*a* in a circumferential direction of the rotation shaft portion 22*a*. By magnetic force of the magnetic seal member 71, developer having entered between the magnetic seal member 71 and the rotation shaft portion 22*a* forms a magnetic brush M. The magnetic brush M blocks the gap between the magnetic seal member 71 and the rotation shaft portion 22*a*, thereby suppressing entry of developer to the bearing member 70, more specifically, the bearing recess portion 70*a*. It is difficult for the developer to pass through the magnetic brush M due to magnetic force, but air can easily pass through the magnetic brush M.

According to the present embodiment, the distance from the magnetic seal member 71 to the outer peripheral surface of the rotation shaft portion 22*a* is formed smaller than the distance between the inner surface of the second recess portion 70*b* and the outer peripheral surface of the rotation shaft portion 22*a*, such that developer cannot easily enter through the gap between the outer peripheral surface of the rotation shaft portion 22*a*.

Space Portion

As according to the present embodiment, if the magnetic seal member 71 is provided to suppress entry of developer to the bearing member 70, the magnetic brush M of developer is formed between the magnetic seal member 71 and the rotation shaft portion 22*a*. In this case, the magnetic brush M contacts the rotation shaft portion 22*a*, but since developer that constitutes the magnetic brush M is mainly composed of toner in the form of particles, contact pressure to the rotation shaft portion 22*a* is small compared to a rubber seal and the like, such that heat is not easily generated when the magnetic brush M slides against the rotation shaft portion 22*a*. However, if the heat generated at the bearing recess portion 70*a* by rotation of the projected end portion 22*c* affects the magnetic brush M of developer, the developer may melt and aggregate to the magnetic seal member 71, so that it is preferable to minimize the influence of heat that is generated at the bearing recess portion 70*a* as much as possible.

In the present embodiment, a space portion X1 is secured between the second recess portion 70*b* and the rotation shaft portion 22*a* in the radial direction and between the bearing recess portion 70*a* and the magnetic seal member 71 in the rotational axis direction. The bearing member 70 is formed in a stepped shape to realize this arrangement. By ensuring the space portion X1, the second recess portion 70*b* will not slide against the rotation shaft portion 22*a*, and heat is not generated by rotation of the agitating screw 22. Further, even if heat is generated at the bearing recess portion 70*a* by rotation of the agitating screw 22, the influence of the heat on the magnetic brush M of developer can be minimized. In other words, a cylindrical portion 70*b*1 is formed by the inner surface of the second recess portion 70*b* that is provided on the developer container and that opposes in a noncontact manner to the peripheral surface of the rotation shaft portion 22*a* in the area between the magnetic seal member 71 and the bearing portion 70*a*1 in the rotational axis direction of the conveyance screw. Distance D1 between the cylindrical portion 70*b*1 and the rotation shaft portion 22*a* in the radial direction is greater than distance D2 between the rotation shaft portion 22*a* and the magnetic seal member 71 in the radial direction.

That is, if the magnetic seal member 71 is adopted as according to the present embodiment to suppress entry of developer to the bearing member 70, for example, air can easily flow into and out of the space portion X1 even through the magnetic brush M, compared to a case where a rubber seal is adopted. If air can flow into and out of the space portion X1, heat generated by the sliding of the projected end portion 22*c* against the bearing recess portion 70*a* can be released. Further, since air flows into and out of the space portion X1, developer that has entered the space portion X1 will easily be taken into the magnetic brush M formed by the magnetic seal member 71, such that developer does not remain in the space portion X1. Air can flow into and out of the space portion X1 since the bearing member 70 is designed so that the projected end portion 22*c* does not pass through the bearing member 70 and exposed to the exterior of the developer container 30.

As described, according to the present embodiment, the magnetic seal member 71 is adopted to suppress entry of developer to the bearing member 70 and form a magnetic brush M that generates little heat by sliding movement to slide against the rotation shaft portion 22*a*, so that generation of heat is suppressed compared to the case where a rubber seal is adopted. Further, providing the space portion X1 enables to block transmission of heat that has been generated at the bearing recess portion 70*a* by sliding of the projected end portion 22*c*, and also enables heat that has been generated at the bearing recess portion 70*a* to be released, so that the heat generated at the bearing recess portion 70*a* will not easily affect the magnetic brush M. As described, according to the present embodiment, entry of developer to the bearing member 70 can be suppressed and influence of heat generated by the rotation of the agitating screw 22 to developer can be minimized by a simple configuration where the agitating screw 22 is supported by bearing members 70 that are non-opened.

Second Embodiment

Figure 5:
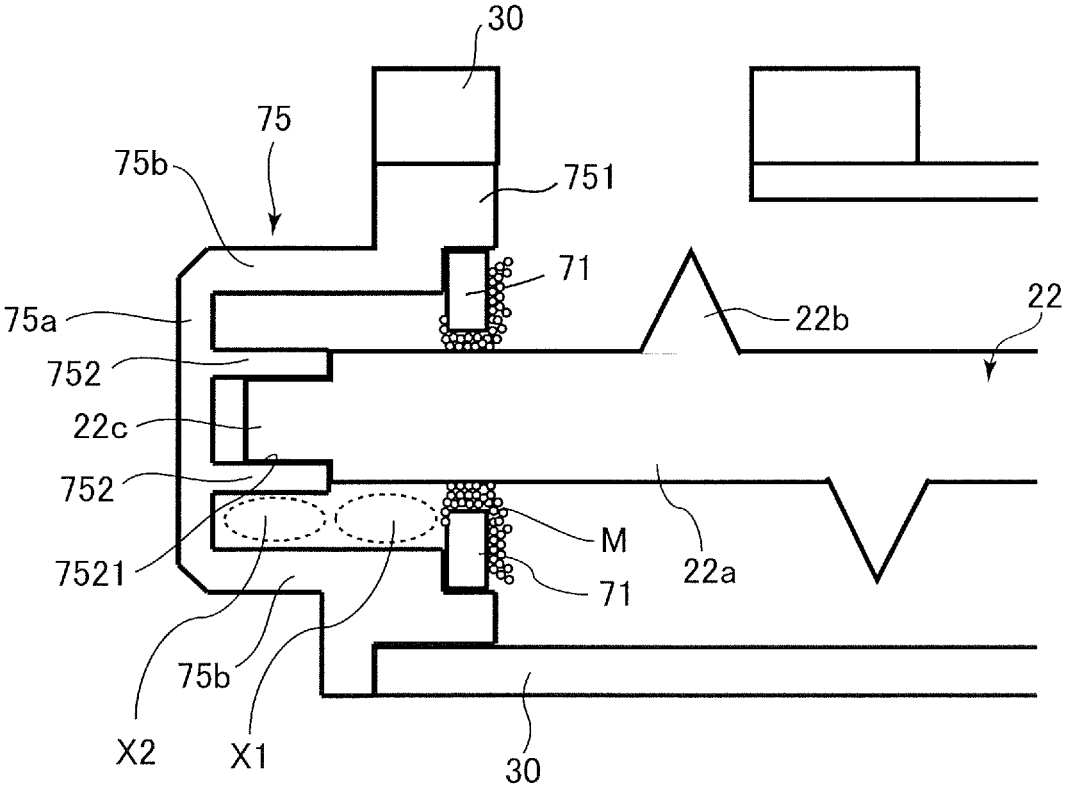
FIG. 5 is a cross-sectional view illustrating a vicinity of a bearing member according to a second embodiment in enlarged view.

A bearing member 75 according to a second embodiment will now be described with reference to FIG. 5. The bearing member 75 of the second embodiment differs from the bearing member 70 according to the first embodiment (refer to FIG. 4) in that in the present configuration, a space portion X2 adjacent to the space portion X1 in the rotational axis direction is secured, as illustrated in FIG. 5.

The bearing member 75 of the second embodiment engages with the rotation shaft portion 22*a* at the end portion in the rotational axis direction of the agitating screw 22 and rotatably supports the agitating screw 22. Similar to the first embodiment described above, the agitating screw 22 includes a projected end portion 22*c* serving as a projected portion protruding in a rotational axis direction from an end portion of a rotation shaft portion 22*a*. Meanwhile, the bearing member 75 serving as the bearing includes a main body recess portion 751 that is formed cylindrically in a non-opened manner, and a bearing recess portion 752 that is formed cylindrically in a non-opened manner and that engages the projected end portion 22*c* to rotatably support the agitating screw 22.

The main body recess portion 751 includes a bottom portion 75*a* and a wall portion 75*b* erected from the bottom portion 75*a*, wherein the bearing recess portion 752 is erected from the bottom portion 75*a* such that a gap is formed in the radial direction between the bearing recess portion 752 and the main body recess portion 751, to be more precise, the wall portion 75*b* on the inner side of the main body recess portion 751. In other words, an inner diameter of the bearing recess portion 752 is approximately equivalent to a diameter of the projected end portion 22*c* but somewhat smaller, and it is smaller than an inner diameter of the main body recess portion 751, to be more precise, the wall portion 75*b*. Moreover, a length of the bearing recess portion 752 in the rotational axis direction is shorter than a length of the wall portion 75*b* in the rotational axis direction.

In a state where the projected end portion 22*c* is rotatably inserted to the bearing recess portion 752, the bearing recess portion 752 and the projected end portion 22*c* may be engaged with one another. As described, even according to the present embodiment, the bearing member 75 is formed to cover an end portion, that is, the projected end portion 22*c*, of the rotation shaft portion 22*a* so that the projected end portion 22*c* does not pass through the bearing member 75 and be exposed to the exterior of the developer container 30. In other words, the bearing recess portion 752 according to the present embodiment can be referred to as an annular projection that is protruded from an inner side surface of the developer container and the projected end portion 22*c* serving as an engagement portion of the rotation shaft portion 22*a* of the agitating screw 22 is supported in a rotatable manner by an inner surface of the projection. It is preferable that the wall portion 75*b* has an inner diameter that is formed smaller than an outer diameter of the agitating screw including the helical blade 22*b*.

The magnetic seal member 71 is arranged on the bearing member 75 toward an inner side of the developer container 30 with respect to the rotational axis direction and is capable of magnetically blocking entry of developer to the bearing member 75, more precisely, the bearing recess portion 752. That is, similar to the first embodiment described above, entry of developer to the bearing member 75 is suppressed by having the gap between the magnetic seal member 71 and the rotation shaft portion 22*a* blocked by the magnetic brush M formed between the magnetic seal member 71 and an outer peripheral surface of the rotation shaft portion 22*a*.

Space Portion

According to the present embodiment, the bearing member 75 is designed so that the space portion X1 is secured between the wall portion 75*b* and the rotation shaft portion 22*a* in the radial direction and the space portion X2 is secured between the wall portion 75*b* and the bearing recess portion 752. Since the bearing recess portion 752 is arranged with a gap formed from the wall portion 75*b*, the space portion X2 that is communicated with the space portion X1 is secured on the outer peripheral side of the bearing recess portion 752. In other words, the space portion X1 according to the first embodiment described earlier (refer to FIG. 4) is expanded toward the bearing recess portion 752. By ensuring the space portion X1 and the space portion X2, even if heat is generated at the bearing recess portion 752 by rotation of the agitating screw 22, the influence of the heat on the magnetic brush M of developer can be minimized.

In the example illustrated in FIG. 5, the space portion X1 and the space portion X2 have the same diameters in the radial direction, but they do not necessarily have the same diameters. For example, the bearing member 75 may include the space portion X1 and the space portion X2 that have different inner diameters that are smaller than the outer diameter of the magnetic seal member 71 and that are greater than the inner diameter of the magnetic seal member 71.

According to the bearing member 75 of the second embodiment, in a state where an amount of developer exceeds the amount of developer that can be captured by the magnetic brush M, developer that enters the side of the bearing recess portion 752 without being captured by the magnetic brush M can be gathered in the space portion X2. In other words, compared to the first embodiment described above, more developer is allowed to enter the side of the bearing recess portion 752. Developer having entered the space portion X2 may melt by the heat generated by the rotation of the agitating screw 22 and aggregate after being cooled, but it will not affect the rotation of the agitating screw 22.

As described, even according to the present embodiment, a similar effect as the first embodiment described earlier can be achieved, where entry of developer to the bearing member 75 can be suppressed and influence of heat generated by the rotation of the agitating screw 22 on the developer can be minimized by a simple configuration. Further according to the present embodiment having the space portion X2, the amount of developer that is allowed to enter the bearing member 75 without causing developer to adhere to the bearing member 75 is increased compared to the first embodiment. Since adhesion of the bearing member 75 at an early stage can be prevented, long life of the developing apparatus 3 can be realized, and since replacement cycle of the developing apparatus 3 is extended, costs related to replacement of the developing apparatus 3 can be cut down.

Other Embodiments

The above-described embodiments have described a case where the bearing recess portion 70*a* (refer to FIG. 4) or the bearing recess portion 752 (refer to FIG. 5) is engaged with the projected end portion 22*c* by which the agitating screw 22 is positioned in the rotational axis direction, but the present invention is not restricted to this example. For example, in a case where the projected end portion 22*c* is not provided at the end of the rotation shaft portion 22*a*, the bearing recess portion 70*a* or the bearing recess portion 752 can be engaged with the rotation shaft portion 22*a*. In that case, positioning of the agitating screw 22 can be performed by the agitating screw 22 abutting against a surface of bearing recess portion 70*a* that is opposed to the tip surface (end surface) of the rotation shaft portion 22*a*. However, since the area sliding against the agitating screw 22 is expanded according to such arrangement, the amount of heat being generated is increased. In consideration thereof, it is preferable to provide the projected end portion 22*c* at the end of the rotation shaft portion 22*a* such that a tip surface of the projected end portion 22*c* does not slide against the bearing recess portion 70*a* during rotation.

The first and second embodiments described above are not restricted to application in the developing apparatus 3, and they are applicable to various types of developing apparatuses having a conveyance screw for conveying developer provided therein. Examples of such developing apparatuses include a toner replenishment apparatus that replenishes toner from the toner bottle 605 to the developing apparatus 3, and a cleaning device, such as the photosensitive drum cleaner 5 or the transfer cleaner device 8, that removes developer remaining on the photosensitive drum 1 and the intermediate transfer belt 61.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-040944, filed on Mar. 7, 2018, which is hereby incorporated by reference herein in its entirety.

What is claimed is:

1. A developing apparatus comprising:

a developer container made of resin and configured to accommodate developer including magnetic carrier and toner;

a conveyance screw configured to convey the developer in the developer container;

a magnetic seal member arranged to face the conveyance screw in such a manner that the magnetic seal member does not contact the conveyance screw and configured to magnetically seal between the magnetic seal member and the conveyance screw; and a bearing made of resin and attached to the developer container, the bearing comprising a bearing portion configured to rotatably support the conveyance screw, and an attachment portion to which the magnetic seal member is attached, and a connecting portion connecting the bearing portion and the attachment portion, the bearing portion, the attachment portion, and the connecting portion being integrally molded, the connecting portion being disposed further inside of the developer container in a rotational axis direction of the conveyance screw than the bearing portion, the attachment portion being disposed further inside of the developer container in the rotational axis direction of the conveyance screw than the connecting portion, wherein the magnetic seal member attached to the attachment portion is disposed further inside of the developer container in the rotational axis direction of the conveyance screw than an engaged portion of the conveyance screw which is engaged with the bearing portion, wherein the bearing covers an end portion of the conveyance screw in the rotational axis direction of the conveyance screw, and wherein a first gap in a radial direction of the conveyance screw between a first portion of the conveyance screw opposed to the connecting portion in the radial direction of the conveyance screw and the connecting portion is larger than a second gap in the radial direction of the conveyance screw between a second portion of the conveyance screw opposed to the magnetic seal member attached to the attachment portion in the radial direction of the conveyance screw and the magnetic seal member attached to the attachment portion.

2. The developing apparatus according to claim 1, wherein an outer diameter of the engaged portion of the conveyance screw is smaller than an outer diameter of the first portion of the conveyance screw.

3. The developing apparatus according to claim 1, wherein a gap in the rotational axis direction of the conveyance screw between the end portion of the conveyance screw in the rotational axis direction of the conveyance screw and the bearing is 1mm to 3mm.

4. A developing apparatus comprising:

a developer container made of resin and configured to accommodate developer including magnetic carrier and toner, the developer container including: (1) a first chamber; (2) a second chamber separated from the first chamber by a partition wall; (3) a first communication portion through which the developer is permitted to communicate from the first chamber to the second chamber; and (4) a second communication portion through which the developer is permitted to communicate from the second chamber to the first chamber;

a first conveyance screw disposed in the first chamber and configured to convey the developer in a first direction from the second communication portion toward the first communication portion;

a second conveyance screw disposed in the second chamber and configured to convey the developer in a second direction from the first communication portion toward the second communication portion;

a magnetic seal member arranged to face the second conveyance screw in such a manner that the magnetic seal member does not contact the second conveyance screw and configured to magnetically seal between the magnetic seal member and the second conveyance screw, the magnetic seal member being disposed upstream of the first communication portion in the second direction; and a bearing made of resin and attached to the developer container, the bearing comprising a bearing portion configured to rotatably support the second conveyance screw, an attachment portion to which the magnetic seal member is attached, and a connecting portion connecting the bearing portion and the attachment portion, the bearing portion, the attachment portion, and the connecting portion being integrally molded, the connecting portion being disposed downstream of the bearing portion in the second direction, the attachment portion being disposed downstream of the connecting portion in the second direction, the bearing being disposed upstream of the first communication portion in the second direction, wherein the magnetic seal member attached to the attachment portion is disposed downstream of an engaged portion of the second conveyance screw which is engaged with the bearing portion in the second direction, wherein the bearing covers an upstream side end portion of the second conveyance screw in the second direction, and wherein a first gap in a radial direction of the second conveyance screw between a first portion of the second conveyance screw opposed to the connecting portion in the radial direction of the second conveyance screw and the connecting portion is larger than a second gap in the radial direction of the second conveyance screw between a second portion of the second conveyance screw opposed to the magnetic seal member attached to the attachment portion in the radial direction of the second conveyance screw and the magnetic seal member attached to the attachment portion.

5. The developing apparatus according to claim 4, further comprising:

a further magnetic seal member arranged to face the second conveyance screw in such a manner that the further magnetic seal member does not contact the second conveyance screw and configured to magnetically seal between the further magnetic seal member and the second conveyance screw, the further magnetic seal member being disposed downstream of the second communication portion in the second direction; and a further bearing made of resin and attached to the developer container, the further bearing comprising a further bearing portion configured to rotatably support the second conveyance screw and a further attachment portion to which the further magnetic seal member is attached, the further bearing portion and the further attachment portion being integrally molded, wherein the further magnetic seal member attached to the further attachment portion is disposed upstream of a further engaged portion of the second conveyance screw which is engaged with the further bearing portion in the second direction.

6. The developing apparatus according to claim 4, further comprising:

a further magnetic seal member arranged to face the first conveyance screw in such a manner that the further magnetic seal member does not contact the first conveyance screw and configured to magnetically seal between the further magnetic seal member and the first conveyance screw, the further magnetic seal member being disposed upstream of the second communication portion in the first direction, a further bearing made of resin and attached to the developer container, the further bearing comprising a further bearing portion configured to rotatably support the first conveyance screw and a further attachment portion to which the further magnetic seal member is attached, the further bearing portion and the further attachment portion being integrally molded, wherein the further magnetic seal member attached to the further attachment portion is disposed downstream of a further engaged portion of the first conveyance screw which is engaged with the further bearing portion in the first direction.

7. The developing apparatus according to claim 4, further comprising:

a further magnetic seal member arranged to face the first conveyance screw in such a manner that the further magnetic seal member does not contact the first conveyance screw and configured to magnetically seal between the further magnetic seal member and the first conveyance screw, the further magnetic seal member being disposed downstream of the first communication portion in the first direction, a further bearing made of resin and attached to the developer container, the further bearing comprising a further bearing portion configured to rotatably support the first conveyance screw and a further attachment portion to which the further magnetic seal member is attached, the further bearing portion and the further attachment portion being integrally molded, wherein the magnetic seal member attached to the attachment portion is disposed upstream of a further engaged portion of the first conveyance screw which is engaged with the further bearing portion in the first direction.

8. The developing apparatus according to claim 4, wherein an outer diameter of the engaged portion of the second conveyance screw is smaller than an outer diameter the first portion of the second conveyance screw.

9. The developing apparatus according to claim 4, wherein a gap in the second direction between the upstream side end portion of the second conveyance screw in the second direction and the bearing is 1 mm to 3mm.

10. A developing apparatus comprising:

a developer container made of resin and configured to accommodate developer including magnetic carrier and toner;

a conveyance screw configured to convey the developer in the developer container;

a magnetic seal member arranged to face the conveyance screw in such a manner that the magnetic seal member does not contact the conveyance screw and configured to magnetically seal between the magnetic seal member and the conveyance screw; and a bearing made of resin and attached to the developer container, the bearing comprising a bearing portion configured to rotatably support the conveyance screw and an attachment portion to which the magnetic seal member is attached, and a connecting portion connecting the bearing portion and the attachment portion, the bearing portion, the attachment portion, and the connecting portion being integrally molded, the connecting portion being disposed further inside of the developer container in a rotational axis direction of the conveyance screw than the bearing portion, the attachment portion being disposed further inside of the developer container in the rotational axis direction of the conveyance screw than the connecting portion, wherein the magnetic seal member attached to the attachment portion is disposed further inside of the developer container in the rotational axis direction of the conveyance screw than an engaged portion of the conveyance screw which is engaged with the bearing portion, wherein an outer diameter of the engaged portion of the conveyance screw is smaller than an outer diameter of a first portion of the conveyance screw opposed to the connecting portion in a radial direction of the conveyance screw, and wherein a first gap in the radial direction of the conveyance screw between the first portion of the conveyance screw and the connecting portion is larger than a second gap in the radial direction of the conveyance screw between a second portion of the conveyance screw opposed to the magnetic seal member attached to the attachment portion in the radial direction of the conveyance screw and the magnetic seal member attached to the attachment portion.

11. The developing apparatus according to claim 10, wherein a gap in the rotational axis direction of the conveyance screw between an end portion of the conveyance screw in the rotational axis direction of the conveyance screw and the bearing is 1mm to 3mm.

12. A developing apparatus comprising:

a developer container made of resin and configured to accommodate developer including magnetic carrier and toner, the developer container including: (1) a first chamber; (2) a second chamber separated from the first chamber by a partition wall; (3) a first communication portion through which the developer is permitted to communicate from the first chamber to the second chamber; and (4) a second communication portion through which the developer is permitted to communicate from the second chamber to the first chamber;

a first conveyance screw disposed in the first chamber and configured to convey the developer in a first direction from the second communication portion toward the first communication portion;

a second conveyance screw disposed in the second chamber and configured to convey the developer in a second direction from the first communication portion toward the second communication portion;

a magnetic seal member arranged to face the second conveyance screw in such a manner that the magnetic seal member does not contact the second conveyance screw and configured to magnetically seal between the magnetic seal member and the second conveyance screw, the magnetic seal member being disposed upstream of the first communication portion in the second direction; and a bearing made of resin and attached to the developer container, the bearing comprising a bearing portion configured to rotatably support the second conveyance screw, an attachment portion to which the magnetic seal member is attached, and a connecting portion connecting the bearing portion and the attachment portion, the bearing portion, the attachment portion, and the connecting portion being integrally molded, the connecting portion being disposed downstream of the bearing portion in the second direction, the attachment portion being disposed downstream of the connecting portion in the second direction, the bearing being disposed upstream of the first communication portion in the second direction, wherein the magnetic seal member attached to the attachment portion is disposed downstream of an engaged portion of the second conveyance screw which is engaged with the bearing portion in the second direction, wherein an outer diameter of the engaged portion of the second conveyance screw is smaller than an outer diameter of a first portion of the second conveyance screw opposed to the connecting portion in a radial direction of the second conveyance screw, and wherein a first gap in the radial direction of the second conveyance screw between the first portion of the second conveyance screw and the connecting portion is larger than a second gap in the radial direction of the second conveyance screw between a second portion of the second conveyance screw opposed to the magnetic seal member attached to the attachment portion in the radial direction of the second conveyance screw and the magnetic seal member attached to the attachment portion.

13. The developing apparatus according to claim 12, further comprising:

a further magnetic seal member arranged to face the second conveyance screw in such a manner that the further magnetic seal member does not contact the second conveyance screw and configured to magnetically seal between the further magnetic seal member and the second conveyance screw, the further magnetic seal member being disposed downstream of the second communication portion in the second direction; and a further bearing made of resin and attached to the developer container, the further bearing comprising a further bearing portion configured to rotatably support the second conveyance screw and a further attachment portion to which the further magnetic seal member is attached, the further bearing portion and the further attachment portion being integrally molded, wherein the further magnetic seal member attached to the further attachment portion is disposed upstream of a further engaged portion of the second conveyance screw which is engaged with the further bearing portion in the second direction.

14. The developing apparatus according to claim 12, further comprising:

a further magnetic seal member arranged to face the first conveyance screw in such a manner that the further magnetic seal member does not contact the first conveyance screw and configured to magnetically seal between the further magnetic seal member and the first conveyance screw, the further magnetic seal member being disposed upstream of the second communication portion in the first direction; and a further bearing made of resin and attached to the developer container, the further bearing comprising a further bearing portion configured to rotatably support the first conveyance screw and a further attachment portion to which the further magnetic seal member is attached, the further bearing portion and the further attachment portion being integrally molded, wherein the further magnetic seal member attached to the further attachment portion is disposed downstream of a further engaged portion of the first conveyance screw which is engaged with the further bearing portion in the first direction.

15. The developing apparatus according to claim 12, further comprising:

a further magnetic seal member arranged to face the first conveyance screw in such a manner that the further magnetic seal member does not contact the first conveyance screw and configured to magnetically seal between the further magnetic seal member and the first conveyance screw, the further magnetic seal member being disposed downstream of the first communication portion in the first direction; and a further bearing made of resin and attached to the developer container, the further bearing comprising a further bearing portion configured to rotatably support the first conveyance screw and a further attachment portion to which the further magnetic seal member is attached, the further bearing portion and the further attachment portion being integrally molded, wherein the magnetic seal member attached to the attachment portion is disposed upstream of a further engaged portion of the first conveyance screw which is engaged with the further bearing portion in the first direction.

16. The developing apparatus according to claim 12, wherein a gap in the second direction between an upstream side end portion of the second conveyance screw in the second direction and the bearing is 1mm to 3mm.

* * * * *